US006155011A

United States Patent [19]

Robertson

[11] Patent Number: 6,155,011

[45] Date of Patent: Dec. 5, 2000

[54] FINISH MATERIAL FOR WINDOW OPENINGS

[76] Inventor: Frederick J. Robertson, 17002 SE. 16th St., Vancouver, Wash. 98683

[21] Appl. No.: 09/255,930

[22] Filed: Feb. 23, 1999

[51] Int. Cl.[7] ..... E04B 1/04

[52] U.S. Cl. ..... 52/212; 52/210

[58] Field of Search ..... 52/211, 212, 210, 52/213, 215, 216, 217

[56] References Cited

U.S. PATENT DOCUMENTS

| | | | |
|---|---|---|---|
| 1,150,790 | 8/1915 | Swanson | 52/211 |
| 3,139,703 | 7/1964 | Hilt | 52/211 X |
| 3,449,873 | 6/1969 | Damato et al. | 52/211 X |
| 3,478,478 | 11/1969 | Luebs | 52/211 X |
| 3,729,870 | 5/1973 | Kvalheim et al. . | |
| 4,272,931 | 6/1981 | Stanizzo | 52/211 X |
| 4,389,824 | 6/1983 | Anderson | 52/211 |
| 4,492,062 | 1/1985 | Levenez | 52/211 X |
| 4,811,533 | 3/1989 | Wetsel . | |
| 4,930,274 | 6/1990 | Cummings et al. . | |
| 5,018,325 | 5/1991 | Geen et al. | 52/211 |
| 5,022,204 | 6/1991 | Anderson | 52/211 |
| 5,222,343 | 6/1993 | Anderson . | |
| 5,437,130 | 8/1995 | Raynak . | |
| 5,464,540 | 11/1995 | Biernazki . | |
| 5,644,887 | 7/1997 | Gerhaher et al. . | |
| 5,651,222 | 7/1997 | Bridges et al. | 52/211 |

FOREIGN PATENT DOCUMENTS

| | | | |
|---|---|---|---|
| 2856401 | 7/1980 | Germany | 52/211 |

*Primary Examiner*—Richard Chilcot

*Attorney, Agent, or Firm*—John Smith-Hill; Smith-Hill and Bedell

[57] ABSTRACT

A bottom sill finish material for a window opening is made of synthetic polymer material and has a return portion which extends into the window opening, a sill projection which extends from the return portion beyond vertical wall in which the window opening is formed, and a molding profile portion which extends downward from the sill projection, substantially perpendicular to the return portion.

14 Claims, 5 Drawing Sheets

FINISH MATERIAL FOR WINDOW OPENINGS

BACKGROUND OF THE INVENTION

This invention relates to a finish material for window openings.

In the building trade, it is conventional to build a wood frame wall using relatively rough lumber and finish the interior surface of the wall with gypsum wallboard (GWB). In the event that the wall has a window opening, a window frame is installed with the inner face of the window frame offset outward from the interior of the wall. The return surfaces, which surrounding the window opening and are perpendicular to the interior of the wall, may be finished using either of two principal methods which are known in the building trade as wood wrap and drywall or GWB wrap.

In accordance with the wood wrap technique, a wood sill is placed at the bottom of the window opening in the lower horizontal return portion and is attached to the framing lumber, typically by use of nails, and wood trim pieces are installed in the vertical return portion of the window opening and in the upper horizontal return portion and are attached to the framing lumber. A molding profile is installed over the vertical wall face, typically by nailing to the exposed edges of the trim pieces, in order to conceal the rough edge of the GWB around the opening.

The wood wrap technique is subject to disadvantage because wood is a high maintenance finish material. Nail holes must be filled after installation and a surface finish must be applied. Further, when the structure settles, a wood sill may separate from the GWB on the interior surface of the wall, leaving unsightly cracks.

In accordance with the drywall wrap technique, GWB is attached to the upper and lower horizontal return portions and to the vertical return portions and suitable reinforcing corner beading is installed to protect the corner transition between the vertical wall and the return surfaces bounding the window opening.

The drywall wrap technique is subject to disadvantage because GWB is not a tough material and therefore is not well suited to the type of stress that is applied to a bottom sill.

In construction of a frame wall, lumber that is nominally vertical might not in fact be vertical. Most of the time this is not a significant problem, because any error is not visible. However, if a stud at the edge of a window opening is used for alignment of finish material and it is out-of-plumb, the finish material may itself be out-of-plumb, which could be objectionable.

It is possible to gauge the maximum departure of the sides of a window opening from vertical using a carpenter's level. The error is typically less than ¼" over the height of the window opening.

When a wood wrap is installed, it is usual to use shims to adjust the spacing between the vertical trim pieces and the studs at the vertical sides of the window opening so that the trim pieces are vertical. A similar technique is not used in the drywall wrap technique and consequently there is a significant possibility that the nominally vertical sides of the window opening are not in fact vertical.

It is generally considered that the wood wrap trim technique provides a more attractive finish than the drywall wrap technique. On the other hand, the drywall wrap does not require the services of an additional trade and can be installed at the same time as the GWB is installed over the vertical wall surfaces and therefore the drywall wrap is generally less expensive than wood wrap.

SUMMARY OF THE INVENTION

According to a first aspect of the present invention there is provided a bottom sill finish material for a window opening which is formed in a vertical wall and has an interior wrap of gypsum wallboard, said finish material being made of synthetic polymer material and having a return portion which extends into the window opening, a sill projection which extends from the return portion beyond the vertical wall, and a molding profile portion which extends downward from the sill projection, substantially perpendicular to the return portion.

According to a second aspect of the present invention there is provided a finish material for a window opening which is formed in a vertical wall and has an interior wrap of gypsum wallboard, said finish material comprising an extrusion of synthetic polymer material, the extrusion having a return portion which extends into the window opening and a molding profile portion which is integral with the return portion and extends from the return portion over the vertical wall.

According to a third aspect of the present invention there is provided a method of finishing a window opening in a vertical wall, the wall having an interior surface of gypsum wallboard and the window opening having an interior wrap of gypsum wallboard and having a bottom sill, the method comprising providing a length of bottom sill finish material made of synthetic polymer material and having a return portion, a sill projection which extends from the return portion, and a molding profile portion which extends from the sill projection, substantially perpendicular to the return portion, placing the bottom sill finish material in the window opening so that the return portion extends into the window opening and contacts the bottom sill of the window opening, the sill projection extends from the return portion beyond the vertical wall, and the molding profile portion extends downward from the sill projection in contact with the interior surface of the wall.

According to a third aspect of the present invention there is provided a new and ornamental profile for a finish material for a window opening.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
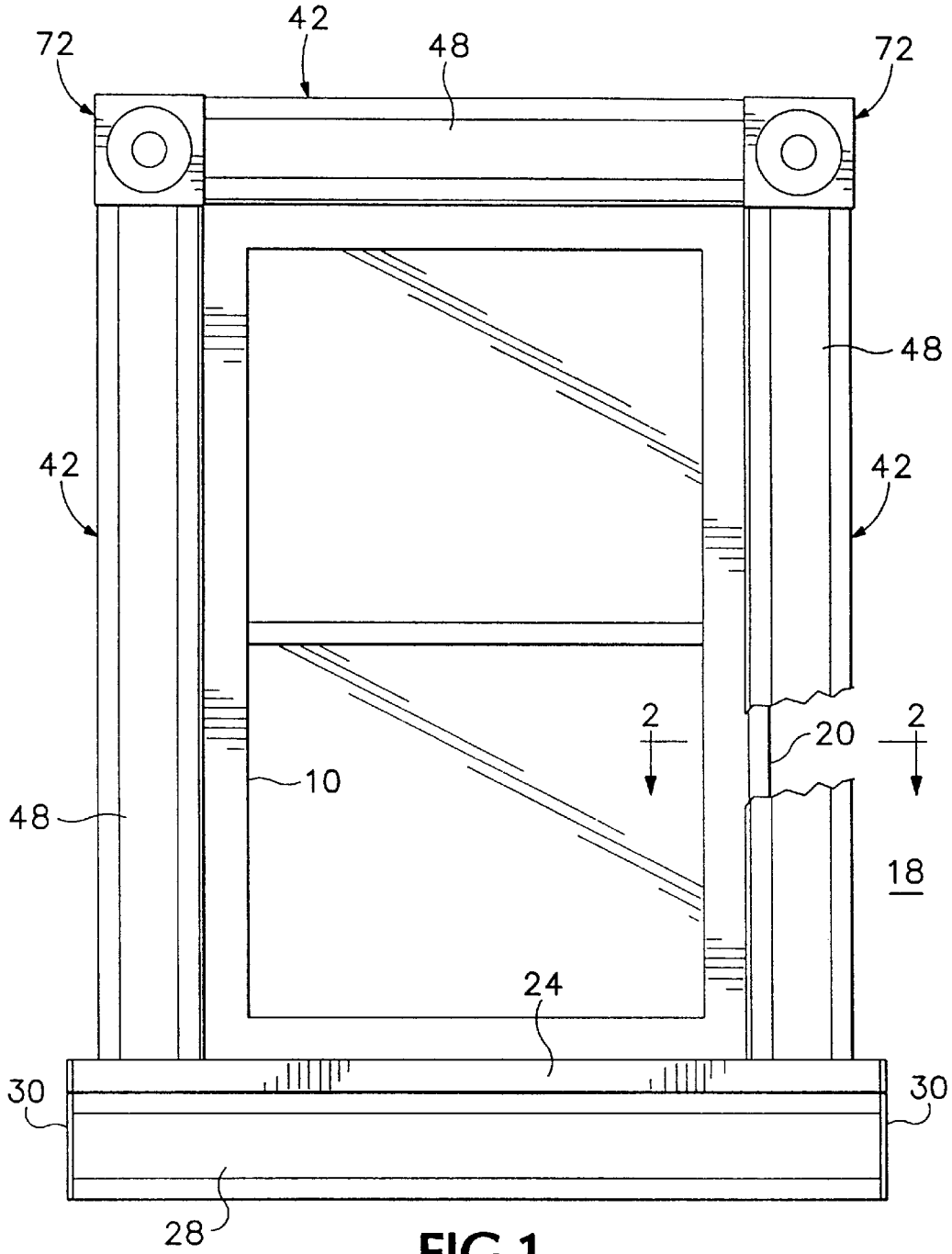
FIG. 1 illustrates a window opening that has been finished using finish material in accordance with the present invention.
Figure 2:
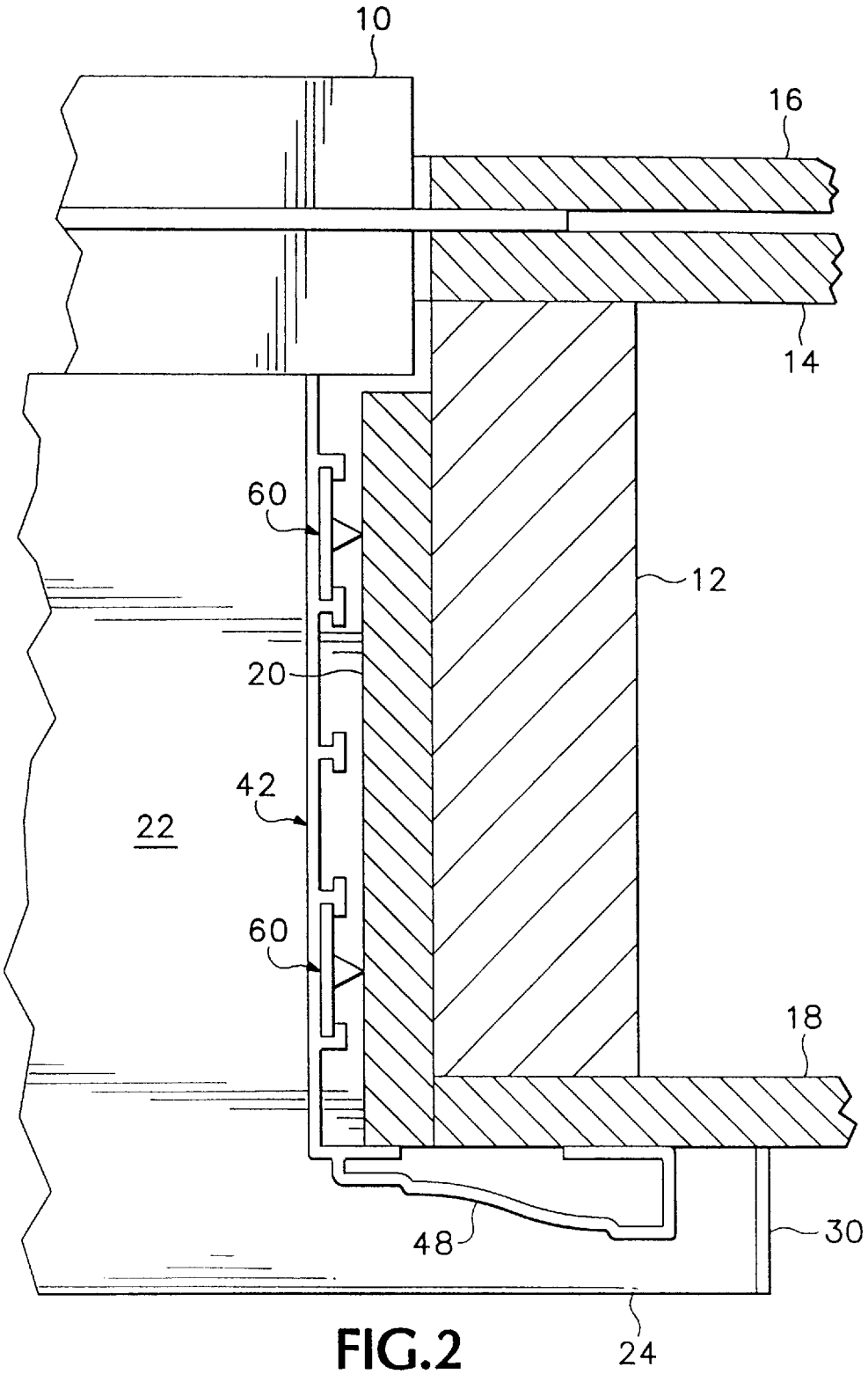
FIG. 2 is a sectional view on the line 2—2 in FIG. 1.

FIGS. 1 and 2 illustrate a window frame 10 installed in a window opening of a wall that has been constructed using conventional wood frame techniques, employing lumber 12, exterior sheathing 14 and siding 16. The interior of the wall has been finished using GWB 18.

Referring to FIG. 2, the window opening has been finished using the conventional drywall wrap technique, in which GWB 20 has been installed in the vertical and horizontal portions of the return which surrounds the window opening. However, it is not necessary to install corner beading.

Figure 3:
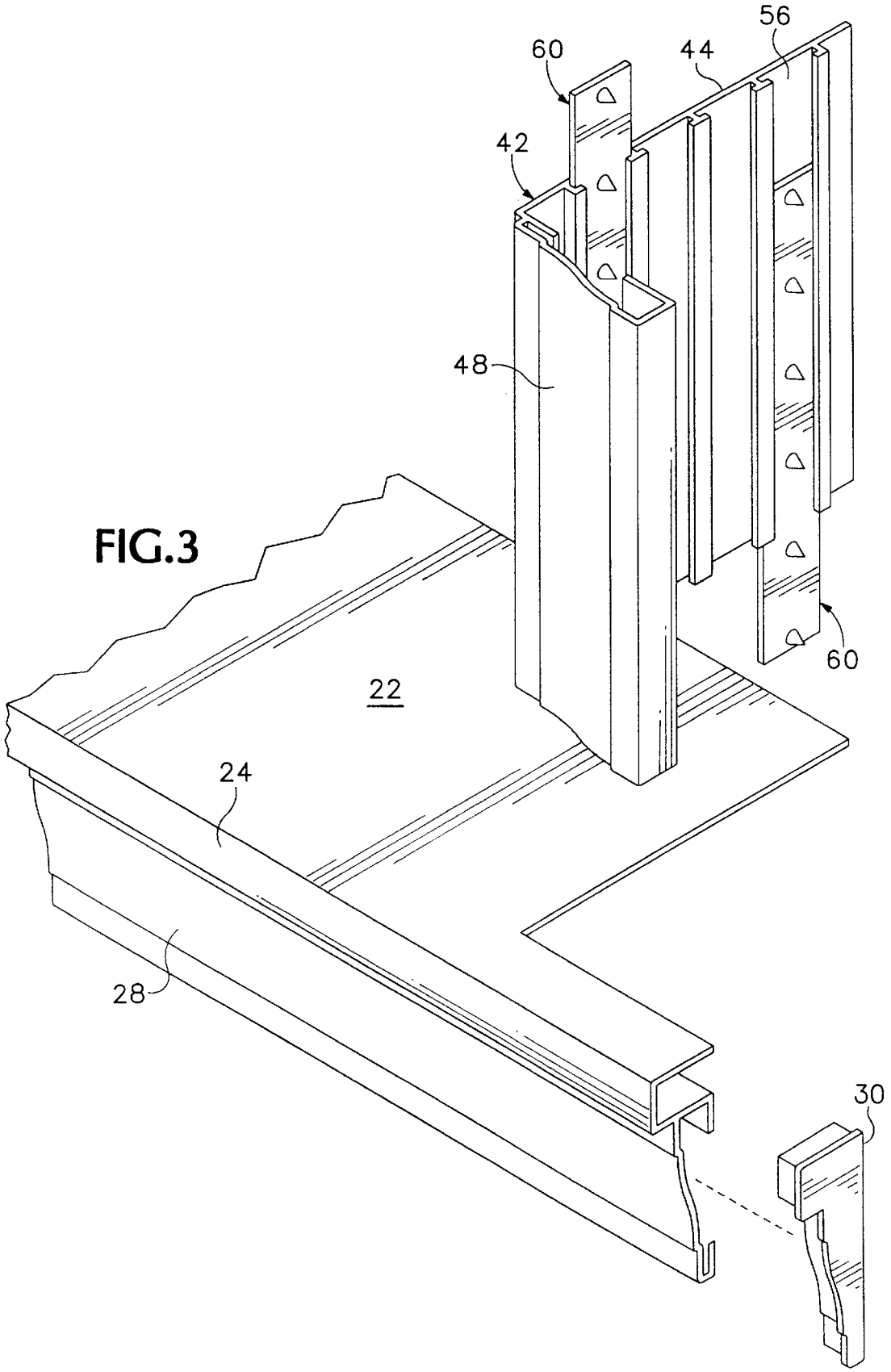
FIG. 3 is a partial exploded view showing a first detail of the finish material shown in FIG. 1.
Figure 4:
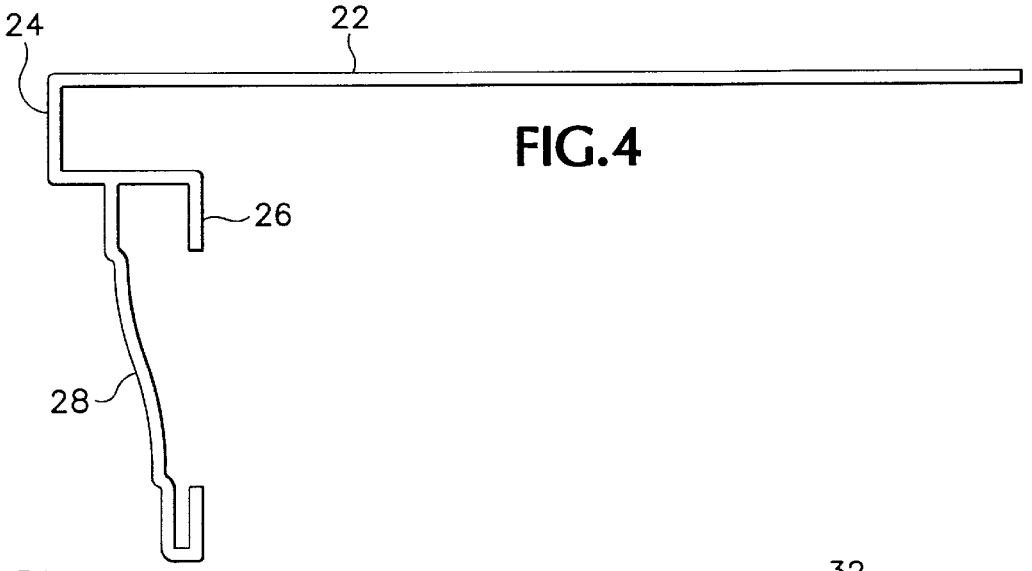
FIG. 4 is a cross sectional view of the bottom sill finish material shown in FIGS. 1 and 2.

In accordance with one aspect of the invention, a bottom sill finish material is installed in the bottom sill of the window opening over the GWB wrap 20. The bottom sill finish material is a one piece extrusion of synthetic polymer material. Referring to FIGS. 3 and 4, the extrusion has a return portion 22, a sill projection 24, a flange 26, and a molding profile portion 28.

In order to install the bottom sill finish material shown in FIG. 3 and 4 in the window opening shown in FIG. 1, a suitable length of the finish material is cut, for example using a utility knife or shears. The length of the bottom sill finish material will generally be several inches greater than the width of the opening as measured between the vertical returns of the GWB wrap 20. The return portion 22 is cut to a width such that the flange portion 26 can be placed firmly against the GWB 18 without interference from the return portion 22 engaging the window frame, and the length of the return portion is cut so that the return portion will fit snugly between the two vertical sides of the window opening. At each end, the finish material is preferably cut in step fashion, as shown in FIG. 3, so that the sill projection 24, the flange portion 26 and the molding profile portion 28 are somewhat longer than the return portion 22.

The bottom sill finish material is installed by using spray adhesive to bond the return portion 22 to the GWB wrap 20 at the bottom sill of the window opening and the flange portion 26 to the GWB 18 over the vertical wall surface beneath the bottom sill. End caps 30 are fitted in the open ends of the rectangular tube formed by the sill projection 24 and in the open ends of the molding profile portion 28. The bottom sill finish material described with reference to FIGS. 1–4 provides an attractive appearance, similar to that of a wood sill, but is less inexpensive to manufacture and install than a wood sill.

Figure 5:
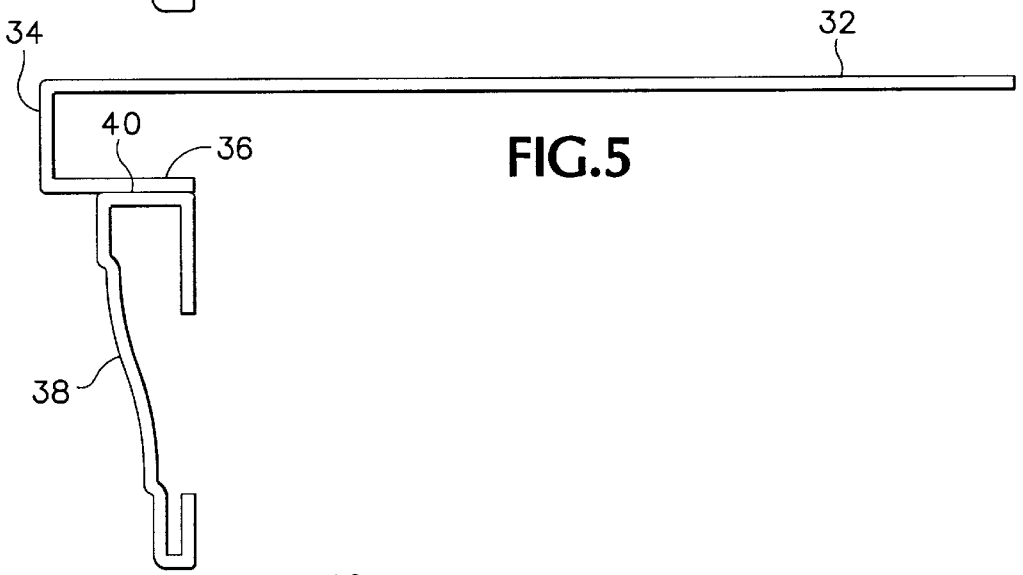
FIG. 5 is a cross sectional view showing a modified form of the finish material shown in FIG. 4.

An alternative form of the bottom sill finish material is shown in FIG. 5. In this case, the finish material is in two parts, namely a sill extrusion of synthetic polymer material and a molding profile extrusion. The sill extrusion has a return portion 32, a sill projection 34 and a lower ledge 36. The molding profile extrusion 38 is attached to the sill extrusion by gluing to the lower ledge 36. This allows the same sill extrusion to be used with different molding profiles.

Figure 6:
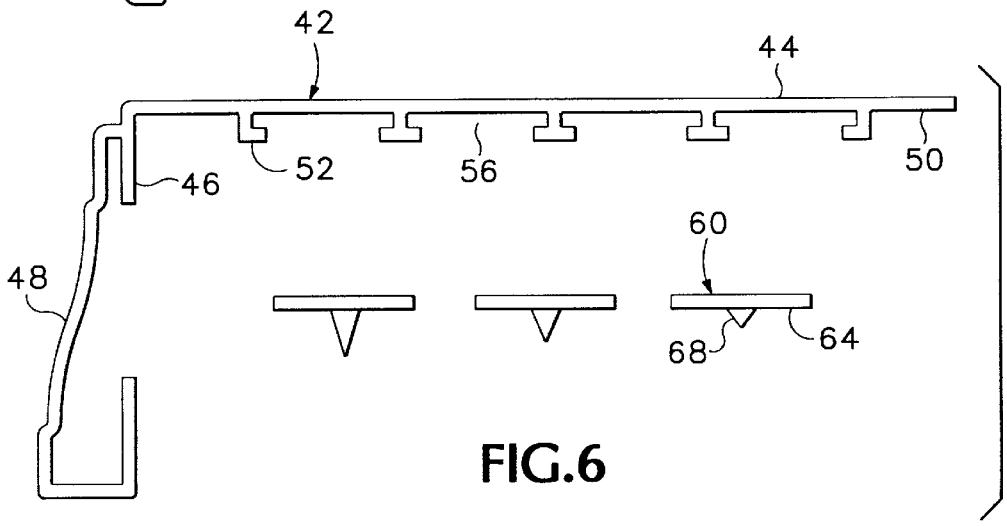
FIG. 6 is a cross sectional view of the side and top finish material shown in FIG. 1.

It may be desired to provide a so-called full wrap around the window, with a molding profile that matches the bottom sill molding profile. In accordance with another aspect of the invention, this may be accomplished using the finish material 42 shown in FIG. 6. The finish material 42 shown in FIG. 6 is a one piece extrusion of synthetic polymer material and has a return portion 44, a flange 46 and a molding profile portion 48. Along the interior surface 50 of the return portion 44, the finish material 42 has ribs 52 defining guideways 56.

The finish material 42 is used in conjunction with elongate strips 60 of molded synthetic polymer material. Each strip 60 has a flat base 64 and pointed pins or projections 68. The base 64 is sized to fit in one of the guideways 56. Different strips have pins 68 of different height, as shown in FIG. 6. Typically, the pins of the different strips are 1/16", 1/8", 3/16" and 1/4" in height.

In order to install the finish material 42, the installer cuts the material to length so that it will fit snugly between the bottom and top sills of the window opening. The installer uses a carpenter's level to determine whether the sides of the window opening are vertical and, if not, gauge the error over the height of the window opening. Having gauged the departure of the side of the window opening from vertical, the installer selects the strip material whose pins are equal in height to, or one size greater in height than, the error and installs lengths of the strip material in the guideways 56. The installer applies spray adhesive to the interior surface 50 of the return portion 44 and fits the length of material 42, with the strips 60 in the guideways 56, against the side of the window opening. When the material 42 has been positioned against the side of the opening, the installer places a straight edge against the finish material 42 and taps the upper or lower end of the straight edge to force the straight edge, and hence the material 42, to vertical, causing the pins 68 to penetrate the GWB. Since the pins are 68 slender, a pin that strikes a nail will be deflected or break off, and will not interfere with the material 42 being brought to vertical.

The spray adhesive, which is applied liberally to the interior surface 50 of the return portion 44 and to the strips 60 in the guideways, has good gap filling properties, and therefore when the adhesive has cured, the adhesive serves not only to bond the finish material to the GWB wrap 20 but also to support the finish material even though parts are spaced from the GWB wrap.

Figure 7:
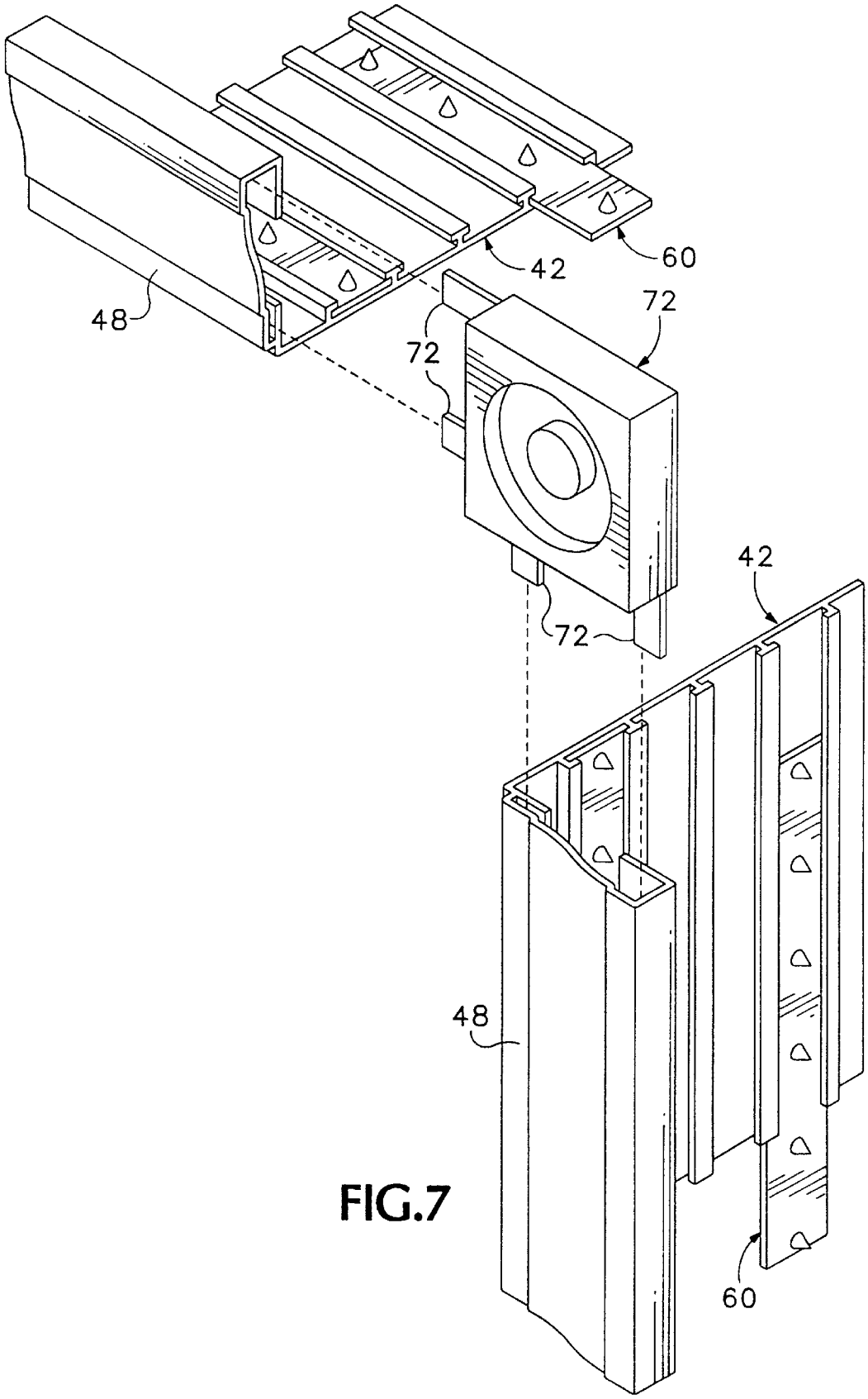
FIG. 7 is a partial exploded view showing a second detail of the finish material shown in FIG. 1.

In similar fashion, the finish material shown in FIG. 6 is used to finish the top of the window opening. As shown in FIG. 7, the upper ends of the molding profile of the side wrap and the ends of the molding profile of the top wrap are finished using molded inserts 72, having prongs 74 that fit in the open ends of the molding profiles 48. The inserts 72 may be rosettes, as shown, or they may be molded to simulate mitered joints between the top wrap and the side wraps. Naturally, it would be possible to miter the ends of the side wraps and top wrap, instead of installing the molded inserts 72, but this is a more labor intensive operation.

As shown in FIG. 1, in the event that a side wrap is used, the extension of the sill projection 24 beyond the sides of the window opening should be at least as great as the width of the molding profile 48 of the side wrap.

The finish materials described above are cheap to manufacture and can be installed quickly and cheaply, without use of nails or power tools. Use of these finish materials avoids the need to install corner beading at the transitions between the vertical wall and the return surfaces bounding the window opening. Further, use of the finish materials permits relatively rough work in installing the GWB 20. Accordingly, the finish materials described above provide a more attractive and more durable finish than the standard drywall wrap without a significant increase in cost.

As indicated previously, the bottom sill finish material may be used without using the finish material 42 to finish the sides and top of the window opening. In the event that the finish material 42 is not used, it may be desirable to modify the configuration of the cut at the ends of the bottom sill finish material in accordance with the profile of the beading used at the transition between the GWB 20 at the sides of window opening and the GWB 18 over the interior surface of the wall. Specifically, the angular cut shown in FIG. 3 would be suitable in the event a corner bead was used, but an arcuate cut would be preferred in the event a bullnose bead were used.

The preferred synthetic polymer material for manufacture of the extrusions shown in the drawings is polyvinyl chloride (PVC). This material can be cut relatively easily using a utility knife or shears, but is nevertheless tough and durable. The extrusions can be given a desired surface finish before installation or they can alternatively be painted in place.

It will be appreciated that the invention is not restricted to the particular embodiment that has been described, and that variations may be made therein without departing from the scope of the invention as defined in the appended claims and equivalents thereof. For example, in the event that a minor departure from vertical or horizontal in the side or top sill could be tolerated, the finish material 42 could be installed without the strips 60. Further, a modified form of the finish material 42 could be fabricated without the ribs 52.

What is claimed is:

1. A bottom sill finish material for a window opening which is formed in a vertical wall and has an interior wrap of gypsum wallboard, said finish material being made of synthetic polymer material and having a return portion which extends into the window opening, a sill projection which extends from the return portion beyond the vertical wall, and a molding profile portion which extends downward from the sill projection, substantially perpendicular to the return portion, and wherein the return portion and the sill projection are portions of a one-piece extrusion and the molding profile portion is a foam core material adhesively bonded to the extrusion.

2. A finish material for a window opening which is formed in a vertical wall and has an interior wrap of gypsum wallboard, said finish material comprising an extrusion of synthetic polymer material, the extrusion having a return portion which extends into the window opening and a molding profile portion which is integral with the return portion and extends from the return portion over the vertical wall, and at least one shim element attached to the return portion at its back side, the shim element having a plurality of pins which project from the return portion to penetrate the gypsum wallboard at least partially when the finish material is installed.

3. A finish material according to claim 4, wherein the shim element is removably attached to the return portion of the extrusion, whereby the shim element can be removed and replaced with a different shim element.

4. A finish material according to claim 3, wherein the extrusion profile has at least two ribs projecting from the return portion and defining a guideway therebetween and the shim element is a strip-form element fitted in the guideway.

5. A method of finishing a window opening in a vertical wall, the wall having an interior surface of gypsum wallboard and the window opening having an interior wrap of gypsum wallboard and having a bottom sill, the method comprising:

providing a length of bottom sill finish material made of synthetic polymer material and having a return portion, a sill projection which extends from the return portion, and a molding profile portion which extends from the sill projection, substantially perpendicular to the return portion, placing the bottom sill finish material in the window opening so that the return portion extends into the window opening and contacts the bottom sill of the window opening, the sill projection extends from the return portion beyond the vertical wall, and the molding profile portion extends downward from the sill projection in contact with the interior surface of the wall.

6. A method according to claim 5, further comprising:

providing a length of side finish material, the side finish material having an extrusion of synthetic polymer material, the extrusion having a return portion and a molding profile portion which is integral with the return portion and extends from the return portion, and placing the side finish material so that the return portion extends into the window opening and is in contact with the side wrap of the window opening and the molding profile portion is in contact with the interior surface of the vertical wall.

7. A method according to claim 6, wherein the side finish material includes at least one shim element attached to the return portion at its back side, the shim element having a plurality of pins which project from the return portion to penetrate the gypsum wallboard of the side wrap at least partially when the finish material is installed.

8. A method according to claim 5, further comprising the step of adhesively bonding the return portion of the bottom sill finish material to the interior wrap of the bottom sill of the window opening.

9. A method of finishing a window opening in a vertical wall, the wall having an interior surface of gypsum wallboard and the window opening having a bottom sill provided with an interior wrap of gypsum wallboard, the method comprising:

(a) providing a length of bottom sill finish material made of synthetic polymer material and having a return portion and a sill projection which extends from the return portion, (b) placing the bottom sill finish material in the window opening so that the return portion extends into the window opening and contacts the gypsum wallboard wrap of the bottom sill of the window opening and the sill projection extends from the return portion beyond the vertical wall, and (c) adhesively bonding the return portion of the bottom sill finish material to the gypsum wallboard wrap of the bottom sill of the window opening.

10. A method according to claim 9, wherein the sill projection of the bottom sill finish material provided in step (a) is substantially U-shaped in cross section, having a first main limb which is an extension of the return portion, a second main limb which is spaced from the first main limb, and a base which connects the second main limb to the first main limb.

11. A method according to claim 10, wherein the bottom sill finish material provided in step (a) has a molding profile portion which extends from the second main limb of the sill projection, substantially perpendicular to the return portion, and step (b) includes placing the bottom sill finish material so that the molding profile portion extends downward from the sill projection in contact with the interior surface of the wall.

12. A method according to claim 9, wherein the bottom sill finish material provided in step (a) has a molding profile portion which extends from the sill projection, substantially perpendicular to the return portion, and step (b) includes placing the bottom sill finish material so that the molding profile portion extends downward from the sill projection in contact with the interior surface of the wall.

13. A method according to claim 9, wherein the window opening has a jamb provided with an interior wrap of gypsum wallboard, and the method further comprises:

providing a length of side finish material made of synthetic polymer material and having a return portion and a molding profile portion which is integral with the return portion and extends from the return portion, placing the side finish material in the window opening so that the return portion of the side finish material extends into the window opening and contacts with gypsum wallboard wrap of the jamb of the window opening and the molding profile portion of the side finish material is in contact with the interior surface of the vertical wall, and adhesively bonding the return portion of the side finish material to the gypsum wallboard wrap of the jamb of the window opening.

14. A method according to claim 13, wherein the side finish material includes at least one shim element attached to the return portion at its back side, the shim element having a plurality of pins which project from the return portion to penetrate the gypsum wallboard of the jamb at least partially when the side finish material is installed.

* * * * *

UNITED STATES PATENT AND TRADEMARK OFFICE
CERTIFICATE OF CORRECTION

PATENT NO. : 6,155,011
DATED : December 5, 2000
INVENTOR(S) : Frederick J. Robertson It is certified that error appears in the above-identified patent and that said Letters Patent is hereby corrected as shown below:

Column 5, line 42 (claim 3, line 1), "4" should be deleted and replaced with --2--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*